US006209937B1

(12) United States Patent
Keiter

(10) Patent No.: US 6,209,937 B1
(45) Date of Patent: Apr. 3, 2001

(54) GUTTER CLEANING DEVICE

(76) Inventor: Robert H. Keiter, 181 E. Highland Rd., Johnson City, TN (US) 37601

( * ) Notice: Subject to any disclaimer, the term of this patent is extended or adjusted under 35 U.S.C. 154(b) by 0 days.

(21) Appl. No.: 09/586,466

(22) Filed: Jun. 3, 2000

(51) Int. Cl.[7] ..... E04D 13/076
(52) U.S. Cl. ..... 294/19.1; 15/236.04
(58) Field of Search ..... 294/19.1, 22, 23, 294/50.8, 106; 15/105, 236.04; 56/333, 334

(56) References Cited

U.S. PATENT DOCUMENTS 2,720,409 * 10/1955 Griffith ..... 294/19.1
3,601,835 * 8/1971 Morgan ..... 294/19.1 X
3,972,552 * 8/1976 Earp ..... 294/19.1
4,057,276 * 11/1977 Currie ..... 294/19.1
4,114,938 * 9/1978 Strader ..... 294/19.1
4,196,927 * 4/1980 Lomaga ..... 294/19.1
4,319,851 * 3/1982 McArthur ..... 294/19.1 X
5,853,209 * 12/1998 McDermott ..... 294/19.1

* cited by examiner

*Primary Examiner*—Johnny D. Cherry

(57) ABSTRACT

A gutter cleaning device having an operator controlled handle and a cleaning head affixed thereto, wherein the head has a pair of clamp arms pivotally mounted on a shaft to allow the arms to freely pivot on the shaft and freely dangle in a work plane, wherein structure is provided to allow the arms and gripping end portions thereon to be moved selectively together and apart in the work plane for easily gripping and releasing gutter debris regardless of the lateral angular orientation of the handle, wherein a specially pivotally mounted mirror is provided on the head, and wherein a motion resistance mechanism engages the mirror for attenuating an angular follow of the mirror relative to an adjustment in lateral angular orientation of the handle, thereby maintaining operator focus on the problem debris field in the gutter.

17 Claims, 3 Drawing Sheets

GUTTER CLEANING DEVICE

BACKGROUND OF THE INVENTION

1. Field

This invention concerns gutter cleaning devices which are constructed for attachment to the end of a long pole or other such support and for actuation by a pull cord or the like adapted to extend from the device to near the ground whereby an operator standing on the ground can actuate the device by pulling on the cord. More specifically, the present device utilizes freely pivotal and dangling clamp arms which can be brought together by the operator's pull on the cord to grasp leaves and other debris in the gutter. The present device further incorporates a specially mounted viewing mirror whereby the target debris in the gutter is kept in the operator's field of vision even though the device may be moved a considerable lateral distance in an arc such as to reach debris in places spaced along the gutter, without necessitating repositioning of the operator on the ground.

2. Prior Art

Heretofore, many constructions for gutter cleaners have been proposed as shown in U.S. Pat. Nos. 2,720,409; 3,601,835; 4,930,824; 5,288,118; 3,972,552; 4,057,276; 4,196,927; 4,930,820; 4,114,938; 5,727,580; 4,310,940; and 4,319,851.

Despite the existence of such an array of patents for gutter cleaning devices which are operated remotely from the ground, none are in common use. Such prior devices have one or more disadvantages including excessive weight, excessive friction between moving parts, clogging of the gripping ends of the arms during operation, lack of a sustained mechanical advantage for the cord pull throughout the cycle of operation, the requirement of the operator standing directly beneath the area being cleaned due to the structure of the device, the need for the operator to walk along while looking up in order to see and grasp debris spaced along the gutter, use of water which adds much weight and wets the user, and inflexibly mounted mirrors that do not afford an optimal view of the target debris as the device is moved in an arc from a substantially vertical posture.

Therefore, the primary objective of the present invention is to provide a device to clear gutters of debris, particularly that which can be pinpointed as obstructing the flow of water. It is not intended that the present device be used only for cleaning gutters of all soil, grit, leaves or the like, nor that as much debris as possible shall be removed in a single gripping operation. The present invention has special utility in providing a unique means by which an average home-owner can scan gutters at regular intervals and selectively target problem areas from which debris must be removed for allowing proper water flow, e.g., throughout the fall season when repeated clogging problems arise. The device further permits flexibility in the operator's standing position such that landscaping features can be preserved, and is capable of removing as much as a bolus of debris or as little as a single leaf. Such debris is easily targeted and held by the device and released at the desired moment and away from sensitive landscape areas.

The mechanical advantages inherent in the present design minimize the pull cord tension needed for its gripping operation which would otherwise be added to the weight of the device to be overcome by the supporting arm of the operator. The operator can then easily maintain cord tension by grasping the cord along with the extension pole with the same hand, thus eliminating cord tension as a force affecting the other arm while the device and pole are swung to a desired unloading position. The gripping operation of the device involves only a single hinge or pivot movement and thus affords negligible friction. The upshot is that even petite home owners will be able to keep gutters free of obstructive debris without risking valuable landscaping, without having to perform feats of strength, and without risking perilous heights. The ease of control of the device minimizes the risk to the operator of becoming soiled, splashed, or struck by debris, thus enhancing the convenience and safety of regular use through the problem seasons.

The present structure contrasts with heavier and multiple hinged prior devices which require more strength and which require the operator to stand directly under the area being cleared. It further contrasts with motorized and water using devices which are likely to subject the operator to a shower of water and waste and with scraping devices that involve the operator moving about while looking up which poses a hazard both to the operator and to landscaping underfoot. The considerable task of physically controlling these prior devices further discourages their regular use.

SUMMARY OF THE INVENTION

The present invention in one of its preferred embodiments is defined as a gutter cleaning device having an operator controlled handle and a cleaning head affixed thereto, wherein the head has an elongated shaft affixed to the handle and has a pair of clamp arms pivotally mounted on the shaft to allow the arms to freely pivot on the shaft and freely dangle in a work plane. Structure is provided to allow the arms and gripping end portions thereon to be moved selectively together and apart in the work plane for easily gripping and releasing gutter debris regardless of the lateral angular orientation of the handle. Also provided is a specially pivotally mounted mirror and a motion resistance mechanism engaging the mirror for attenuating an angular follow of the mirror relative to an adjustment in lateral angular orientation of the handle, thereby maintaining operator focus on the problem debris field.

The present device combines the qualities of economy of construction, very light weight, e.g., about one or two pounds or so for the cleaning head, high mechanical advantage, negligible operational friction, self adjusting grasping angle by virtue of the free pivotal mounting of the arms, self adjusting mirror, and easy attachment to a standard extension pole such as commonly used with paint rollers and the like and often already in possession of the average home owner. With the present device it is easy to scan a long area of gutter with the attached mirror from one standing position by sweeping the device in an arc from side to side, i.e., laterally. The use of sparred or toothed gripping arms or tongs facilitates a mechanical advantage which is sustained throughout the grasping operation. The device can be operated easily at a lateral angle for allowing gutter clearing over sensitive landscaping which would prevent a concientious operator from standing on the landscaping directly beneath the area of the gutter needing cleaning.

BRIEF DESCRIPTION OF THE DRAWINGS

The invention will be further understood from the following description and drawings which are not to scale and wherein certain structural portions are broken away or markedly enlarged for clarity, wherein.

DETAILED DESCRIPTION

Figure 1:
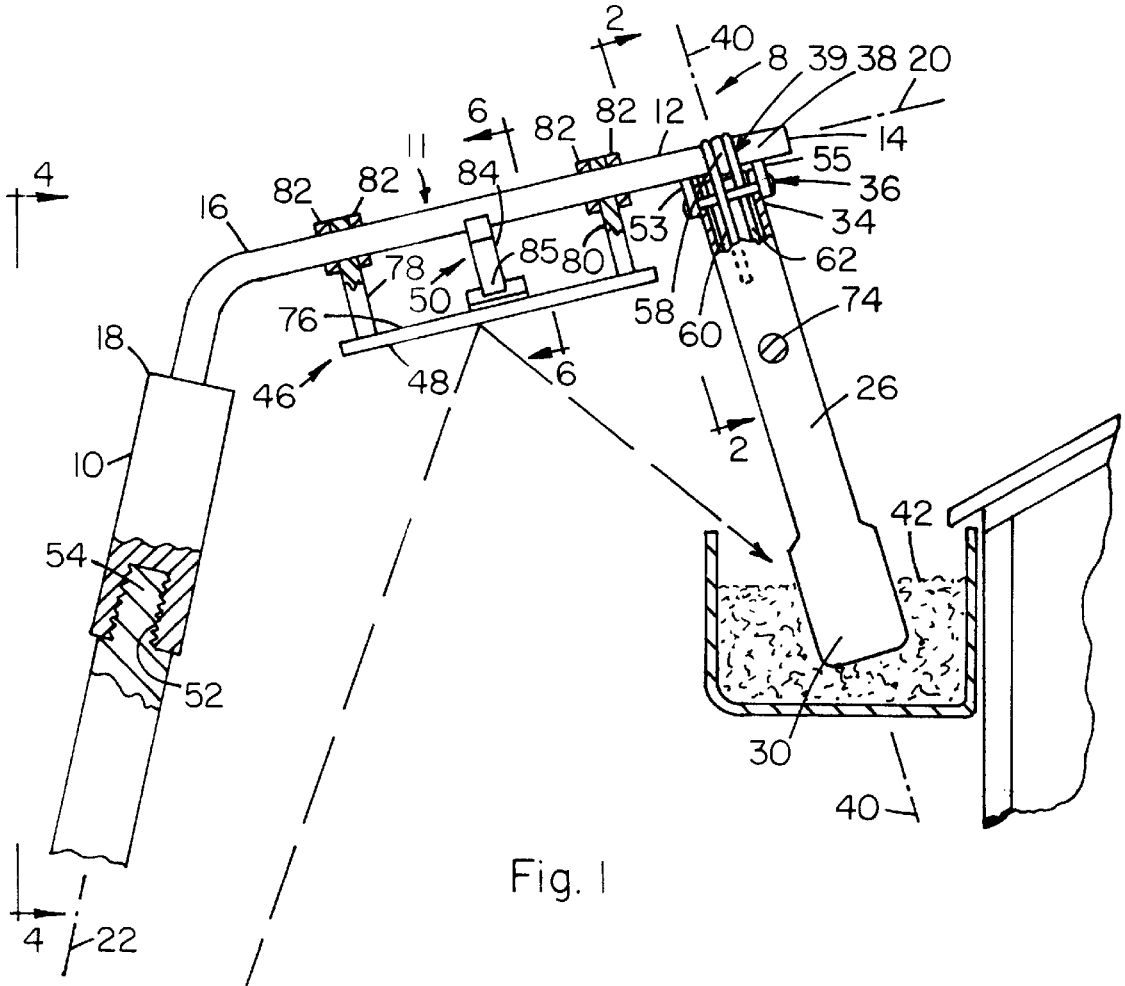
FIG. 1 is a side view of the present device with portions broken away for clarity.

Referring to the drawings and with particular reference to the claims hereof, the present gutter cleaning device 8 is provided with operator controllable handle means 10 and a cleaning head generally designated 11 and comprising elongated support means 12 having a distal end 14 portion and a proximal end portion 16, said proximal end portion being affixed to an end portion 18 of said handle means, said support means extending along a support axis 20 oriented at an obtuse angle $\gamma$ with respect to a longitudinal axis 22 of said handle means, a pair of clamp arms 24,26 each having a gripping end portion 28,30 respectively and a mounting end portion, 32, 34 respectively, cooperating pivot means 36 on said mounting end portions and 38 on said support means for allowing said arms to freely pivot on said support means in a work plane 40 and for allowing said arms and gripping end portions to be moved selectively together or apart in said work plane for gripping or releasing gutter debris 42 regardless of the "lateral angular orientation", ALAO, of said handle means, said work plane 40 being oriented substantially normal to said support axis 20, spring means 43 engaging both arms and urging them apart, pull means 44 engaging said arms and accessible to an operator for bringing said arms together, mirror means 46 pivotally mounted on said support means intermediate said end portions thereof and having a reflector surface 48 oriented substantially parallel to said support axis and adapted to face generally downwardly when in use, and motion resistance means 50 engaging said mirror means for attenuating the angular follow of said reflector surface relative to an ALAO of said handle means whereby the angle of reflection does not increase to a point where the target debris is no longer in the operator's field of vision.

Figure 2:
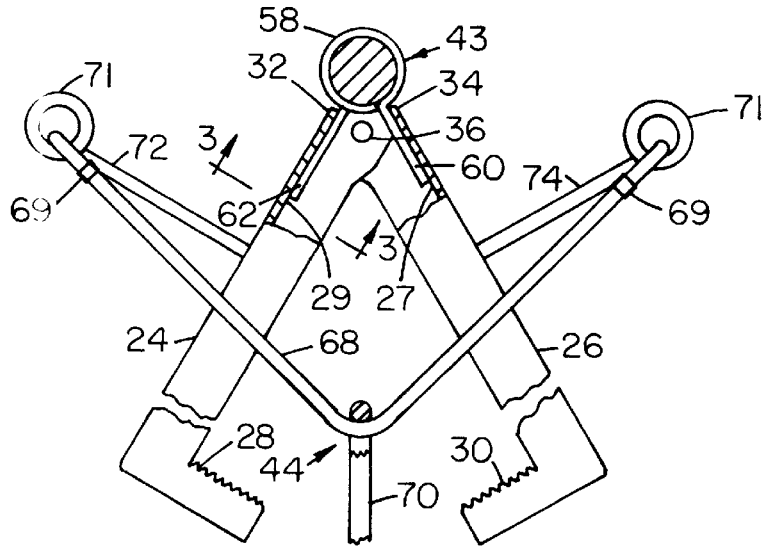
FIG. 2 is a view taken along line 2—2 of FIG. 1 in the direction of the arrows of the cleaning head with portions broken away for clarity.
Figure 3:
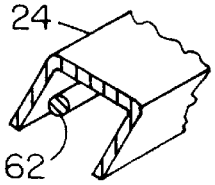
FIG. 3 is an isometric view of a clamp arm taken generally along line 3—3 of FIG. 2 in the direction of the arrows.

The handle means 10, it will be recognized, can be a conventional paint roller type having a threaded end 52 adapted to threadedly receive a matingly threaded end 54 of an extension pole of any length. The support means 12, preferably a round shaft, pivotally supports both the clamp arms and the mirror. These arms are of lightweight construction such as conventional kitchen tongs and can be pivotally mounted on 12 by any convenient means. As shown in the embodiment of FIGS. 1 and 2, the mounting end portions 32, 34 of the arms can be pivoted to each other by a pin 36 mounted thru a pair of stabilizer nibs 53, 55 affixed to shaft 12 which provide pin bearings and lateral stability to the arms. A torsion spring 39 having its coil 58 pivotally mounted on journal surface 38 of shaft 12 and having its legs 60, 62 sprung against the webs 27, 29 of the arm channels urges the arms apart.

The pull means 44 preferably comprises a loop segment 68 and main pull cord 70 which should be sufficiently long to reach from a gutter to the hand of an operator standing on the ground. The ends of segment 68 are tied or looped and ferruled at 69 through eyes 71 in levers 72, 74 affixed to arms 24, 26 respectively. Cord 70 is loosely tied to segment 68 such that it can easily slide along segment 68 when handle 10 and head 11 are moved laterally thru an arc by the operator to view or reach a debris field in the gutter. By the sliding of cord 70 along segment 68, a more equal pull on the levers and minimum dislocation of vertical dangle of the arms arc are realized.

It is particularly noted that the length of the levers is such that an easy pull on cord 70 is sufficient to cause gripping ends 28,30 to grip gutter debris with adequate pressure to lift the debris from the gutter, and whereby release of cord 70 will allow spring means 43 to readily separate the arms to release the debris.

Mirror means 46 may have a flat or convex reflecting surface 48 on a backing plate 76 which is provided with pivot support members 78,80 fixed in position thereon but pivotally mounted on shaft 12. Collars such as 82 affixed to 12, e.g., by set screws, prevent sliding of members 78 and 80 along the shaft.

Figure 4:
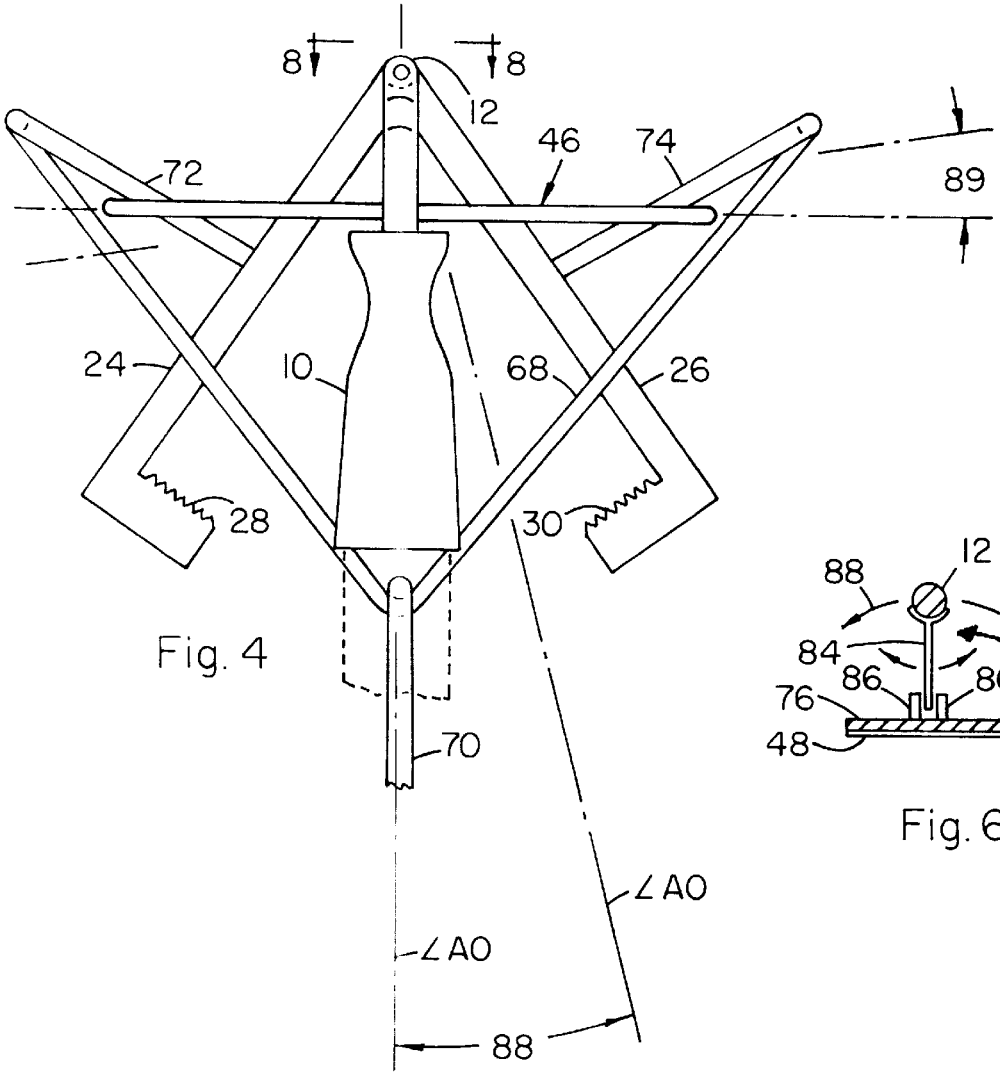
FIG. 4 is an elevational view taken along line 4—4 of FIG. 1 in the direction of the arrows.
Figure 6:
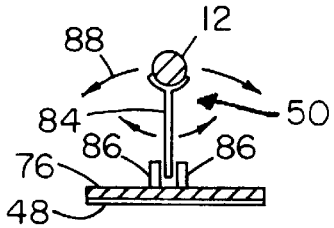
FIG. 6 is a cross-sectional view taken along line 6—6 of FIG. 1 in the direction of the arrows.

The motion resistance means 50 of the type shown in FIGS. 1 and 6 comprises a thin leaf spring or wire spring 84 affixed to shaft 12 and having its lower end 85 extending down loosely between a pair of lugs 86 on plate 76 whereby, as head 11 and shaft 12 are moved thru an arc such as 88 by the operator, the combined inertia of elements 46, 78 and 80 will be partially overcome by spring 84 and allow a predetermined angular follow of the mirror. For example, as shown in FIG. 4, the ALAO 88, e.g., about 19°, results in a significantly lesser angular follow, 89 of the mirror, e.g., about 8°. The composition of spring 84 or of any of the other types of motion resistance means discussed below, and their, dimensions, strength and flex characteristics can be selected by those skilled in the art to give the degree of angular follow desired.

Referring to FIGS. 7, 7A, 7B, 7C and 7D, the structural elements which are the same or equivalent to those of FIGS. 1 and 6 are numbered the same.

Figure 7:
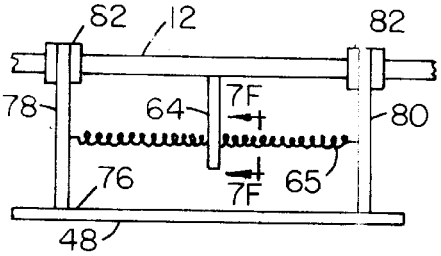
FIGS. 7, 7E, 7A, 7B, 7C, and 7D are views, partially in section, of various alternative motion resistance structures for the mirror.
Figure 7A:
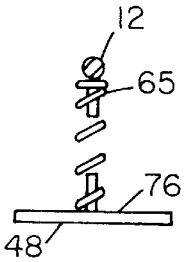
Figure 7B:
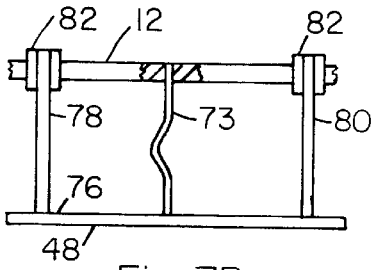
Figure 7C:
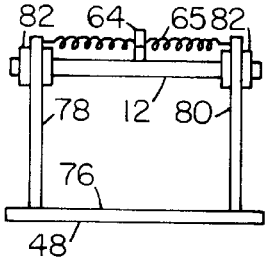
Figure 7D:
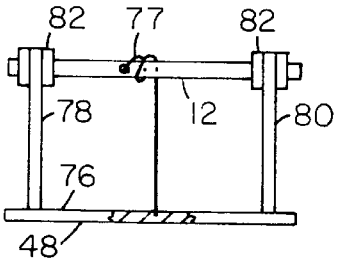
Figure 7E:
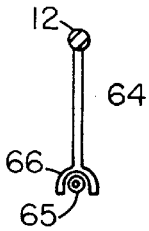

In FIGS. 7 and 7E, a rigid member 64 is affixed at its upper end to shaft 12 and engages at its lower forked end 66 a light coiled spring 65 attached at its ends to members 78 and 80. Rotation of shaft 12 and member 64 will cause spring 65 and mirror 46 to follow, in a diminished sense, the shaft rotation.

In FIG. 7A, the coiled spring 65 is connected to 12 at its upper end and to plate 76 at its lower end. In FIG. 7B one or a pair of spring wires 73 affixed to shaft 12 and plate 76 provide the rotation attenuation. In FIG. 7C, member 64 extends, and spring 65 is positioned above shaft 12. In FIG. 7D, one or more torsion springs 77 are loosely coiled around and fixed to shaft 12 at one end and fixed at the other end to plate 76.

Referring to FIGS. 8, 8A, 8B, 8C, 8D and 8E, the structural elements which are the same or equivalent to those of FIGS. 1 and 2 are numbered the same.

Figure 8:
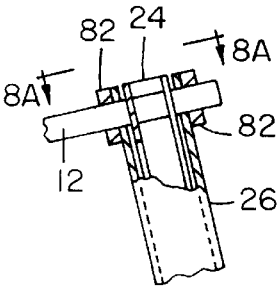
FIGS. 8, 8A, 8B, 8C, 8D and 8E are views of alternative pivot structures for mounting the clamp arms on the support means or shaft.
Figure 8A:
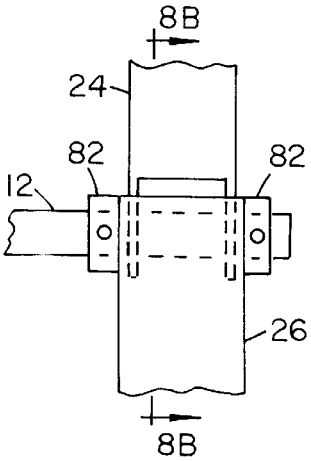
Figure 8B:
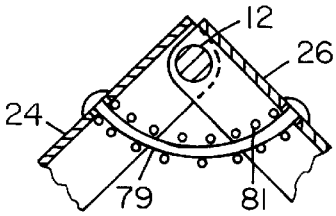

In FIGS. 8, 8A and 8B, arms 24 and 26 are apertured at their mounting ends to mount on shaft 12 and freely rotate thereon. Torsion spring 39 may be used as in FIGS. 1 and 2 or a curved shaft 79 and compression spring 81 as shown in FIG. 8, or equivalent spring mechanism may be employed.

Figure 8C:
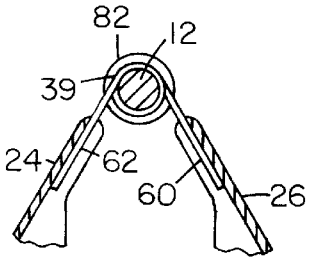

In FIG. 8C, the legs 60, 62 of torsion spring 39 are welded, brazed, or otherwise affixed to arms 26, 24 and spring 39 is freely rotatable on shaft 12. The coil 58 of this spring may be given a larger number of turns in order to further stabilize the arms in their pivoting motion on shaft 12.

Figure 8D:
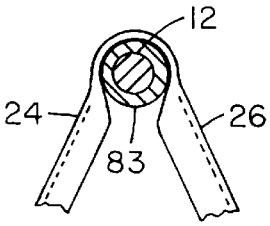
Figure 8E:
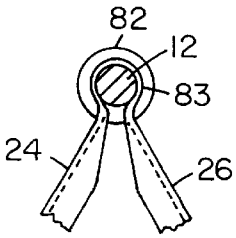

In FIG. 8D, arms 24, 26 of spring steel or the like are affixed to a bearing member 83 preferably of about 0.5 to about one inch in length, which is rotatably mounted on shaft 12 with tolerances which afford good pivotal stability to the arms. In FIG. 8E, the spring steel arms are formed to provide their own integral bearing member 83.

Figure 5:
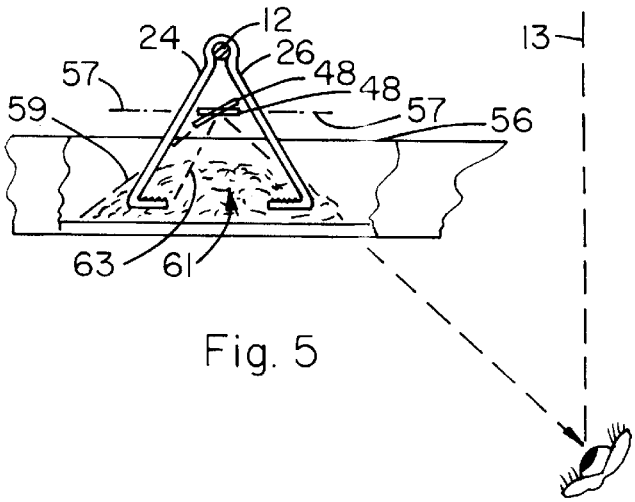
FIG. 5 is a schematic view showing an "adjusted lateral angular orientation", ALAO, of the handle axis and two comparative postures of the mirror.

Referring to FIG. 5, head 11 is shown positioned at a LAO of about 45° from vertical 13 with the freely dangling arms properly positioned within a gutter 56. At this LAO and without the assistance of the present motion resistance means 50, the reflective surface of the mirror, thru its pivotal mounting on 12, would lie in a generally horizontal plane 57 whereby the reflective path 59 from the gutter and to the operator's eye would lie outside of the debris field 61. With the present motion resistance means 50 however, the reflective path now lies along 63 which initiates, as designed, within the debris field.

The invention properly constructed, will allow the operator to assume a position on the ground appropriate to landscaping from which to scan a considerable length of gutter by holding the device via the extension pole above the gutter slightly away from its edge affording a view of the inside of the gutter via the mirror. The mirror, properly suspended with its restraining spring, will afford a downward view, e.g., up to about a 45 degree angle with the extension pole when viewed with a line of sight parallel to the extension pole. This will allow the operator to use the extension pole at an angle from this position both for finding and removing debris. The device is lowered over the debris thus located, the debris and tong or gripping ends being visible in the mirror. The cord is then pulled taut, causing the tongs to grasp the debris. The cord is then clasped by the operator's hand against the extension pole to maintain tautness. The device is then lifted from the gutter and extended downwind to an appropriate location. Releasing the tautness of the cord will then release the debris. This operation is well within the limits of performance of the average healthy adult. Safety goggles are recommended. It is not advisable for operation by individuals with physical limitations who may encounter problems with neck extension or balance or the like. It is intended that the operator may have to change his position on the ground only infrequently while he is viewing and removing debris and the device can be lowered and a new ground position assumed before continuing operation. This will enhance safety of operation.

This invention has been described in detail with particular reference to preferred embodiments thereof, but it will be understood that variations and modifications will be effected within the spirit and scope of the invention.

I claim:

1. A gutter cleaning device having operator controllable handle means and cleaning head, said head comprising elongated support means having a distal end portion and a proximal end portion, said proximal end portion being affixed to an end portion of said handle means, said support means extending along a support axis oriented at an obtuse angle with respect to a longitudinal axis of said handle means, a pair of clamp arms each having a gripping end portion and a mounting end portion, cooperating pivot means on said mounting end portions and said support means for allowing said arms to freely pivot on said support means in a work plane and for allowing said arms and gripping end portions to be brought selectively together or apart in said work plane for gripping or releasing respectively gutter debris regardless of the lateral angular orientation of said handle means, said work plane being oriented substantially normal to said support axis, spring means engaging both arms and urging them apart, pull means engaging said arms and accessible to an operator for bringing said arms together, mirror means pivotally mounted on said support means intermediate said end portions thereof and having a reflector surface oriented substantially parallel to said support axis and adapted to face generally downwardly when in use, and motion resistance means engaging said mirror means for attenuating the angular follow of said reflector surface relative to an adjustment in lateral angular orientation of said handle means whereby the angle of reflection does not increase to a point where the target debris is no longer in the operator's field of vision.

2. The device of claim 1 wherein, thru a progressively increasing lateral angular orientation adjustment of the longitudinal axis of said handle means of 45° from a starting neutral lateral posture thereof, the angular follow of said mirror means will progressively decrease in the range of from about 100% down to about 85% to thereby retain a workable mirror focus on target debris in the gutter.

3. The device of claim 1 wherein said pull means comprises lever means affixed to each of said arms and extending substantially perpendicularly outwardly therefrom, and pull cord means attached to an outer end portion of each said lever means and adapted to extend downwardly for grasping by an operator.

4. The device of claim 3 wherein said pull cord means comprises a cord loop connected at its ends to each said outer end portion of said lever means, and a main pull cord loosely and slidably connected to said loop whereby, thru sliding of said main pull cord along said loop during lateral angular orientation adjustment of said handle means, the operator pull force on both lever means will remain substantially equal.

5. The device of claim 3 wherein the length of each said lever means out to its said outer end portion is equal to from about 0.3 to about 0.6 of the length of the clamp arm to which the lever means is attached.

6. The device of claim 5 wherein said spring means is selected to require a combined pull force on both said lever means of from about 1.3 to about 3.0 lbs., in order to bring said gripping ends together.

7. The device of claim 1 wherein said min or means includes a pivotal mounting thereof on said support means, and said motion resistance means comprises cushion means fixed on said support means or on said mirror means and engaging a portion of said mirror means or said support means, respectively.

8. The device of claim 7 wherein said cushion means is selected from the group consisting of leaf spring means, wire spring means, coiled spring means, torsion spring means and a compressible, resilient body means.

9. The device of claim 1 wherein said pivot means comprises a direct pivotal connection between the mounting ends of said clamp arms, and a torsion spring having its coil pivotally mounted around said support means and having the free ends of its two legs engaging one each of said arms and applying spreading force to said arms.

10. The device of claim 1 wherein at least the major portions of said arms are channel shaped and wherein the channels face each other.

11. The device of claim 10 wherein each said arm is formed to provide a gripping end portion having an upwardly facing channel and having a grip axis lying substantially in a radial orbit about said pivot means, wherein the channel ends of said end portions are in opposition.

12. The device of claim 11 wherein the side segments of the channels of said gripping end portions are toothed for facilitating gripping of debris.

13. The device of claim 1 wherein said reflector surface of said mirror means is a convex, broad view type.

14. The device of claim 1 wherein said mirror means is pivotally mounted on said support means to the proximal side of said clamp arms, and wherein said reflector surface is oriented substantially normal to said work plane.

15. The device of claim 1 wherein said handle means is provided with threaded means at its free end for threadedly receiving the threaded end of an extension pole.

16. The device of claim 1 wherein said obtuse angle is from about 50° to about 70°.

17. The device of claim 1 wherein said arms are joined at their mounting end portions by an integral spring segment, wherein said segment is provided with bushing means pivotally mounted on said support means, and wherein said segment provides said spring means for urging said arms apart.

* * * * *

UNITED STATES PATENT AND TRADEMARK OFFICE

CERTIFICATE OF CORRECTION

PATENT NO. : 6,209,937 B1
DATED : April 3, 2001
INVENTOR(S) : Robert H. Keiter

It is certified that error appears in the above-identified patent and that said Letters Patent is hereby corrected as shown below:

Column 6, claim 7,
Line 1, delete "min or" and insert -- mirror --.

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*